US005445132A

United States Patent [19]

Isobe et al.

[11] Patent Number: 5,445,132

[45] Date of Patent: Aug. 29, 1995

[54] EVAPORATIVE FUEL-PURGING CONTROL SYSTEM FOR INTERNAL COMBUSTION ENGINES

[75] Inventors: Takashi Isobe; Hiroshi Yatani; Fumio Hara, all of Wako, Japan

[73] Assignee: Honda Giken Kogyo Kabushiki Kaisha, Tokyo, Japan

[21] Appl. No.: 338,084

[22] Filed: Nov. 9, 1994

[30] Foreign Application Priority Data

Nov. 10, 1993 [JP] Japan ..... 5-064990 U

[51] Int. Cl.[6] ..... F02M 33/02

[52] U.S. Cl. ..... 123/520; 123/198 D

[58] Field of Search ..... 123/520, 518, 516, 519, 123/521, 198 D, 458

[56] References Cited

U.S. PATENT DOCUMENTS

| | | | |
|---|---|---|---|
| 4,967,713 | 11/1990 | Rojima | 123/520 |
| 5,188,085 | 2/1993 | Habagochi | 123/520 |
| 5,216,995 | 6/1993 | Hosoda | 123/520 |
| 5,231,969 | 8/1993 | Suga | 123/520 |
| 5,259,353 | 11/1993 | Nakai | 123/520 |
| 5,263,460 | 11/1993 | Baxter | 123/520 |
| 5,263,461 | 11/1993 | Fujimoto | 123/520 |
| 5,299,544 | 4/1994 | Kitamoto | 123/520 |
| 5,323,751 | 6/1994 | Osanai | 123/520 |
| 5,329,909 | 7/1994 | Hosoda | 123/520 |
| 5,368,002 | 11/1994 | Hoshino | 123/520 |

*Primary Examiner*—Carl S. Miller

*Attorney, Agent, or Firm*—Nikaido, Marmelstein, Murray & Oram

[57] ABSTRACT

An improved evaporative fuel-purging control system for controlling a purging flow rate which is controlled by a solenoid purge control valve regulated with a pulse waveform signal. As for the characteristic of the purge control valve, differing periods of the signal differentiates the control valve linearity of purging flow rate with respect to the signal duty ratio. To improve the linearity, the pulse waveform signal period which creates the substantial linearity is selected among preset periods periods according to the preset duty ratio which works as a threshold value.

22 Claims, 4 Drawing Sheets

EVAPORATIVE FUEL-PURGING CONTROL SYSTEM FOR INTERNAL COMBUSTION ENGINES

BACKGROUND OF THE INVENTION

1. Field of the Invention

The present invention relates to an evaporative fuel supply system of an internal combustion engine for introducing evaporative fuel, which is generated within a fuel tank, into an intake passage of the internal combustion engine, and more particularly to an evaporative fuel-purging control system for controlling a purging flow rate of the evaporative fuel.

2. Related Background Art

Conventionally, evaporative fuel-supply systems which introduce evaporative fuel generated in a fuel tank into an intake passage of an internal combustion engine have been widely used for automotive vehicles and the like. In view of preventing air pollution, the evaporative fuel-supply system is used for prevention of evaporative fuel containing a large amount of hydrocarbon (HC) from being emitted from a fuel tank into the atmosphere.

In a typical type of the systems, a canister containing an adsorbent such as activated carbon is used. The evaporative fuel evaporated inside the fuel tank is fed into the canister through a passage connecting the fuel tank with the canister and adsorbed by the adsorbent in the canister. In operation of the internal combustion engine, the adsorbed fuel is removed from the adsorbent in the canister by negative intake pressure generated in the intake passage. The removed evaporative fuel is then purged into the intake passage of the internal combustion engine through a purging passage or purging line connecting the canister with the intake passage.

Purging the evaporative fuel into the intake passage increases the concentration of fuel in gaseous mixture to be supplied to the internal combustion engine, thereby deviating the mixing ratio of the gaseous mixture out of a desired value.

To overcome this disadvantage, Japanese Patent Laid-Open No. 62-174557 (174557/1987) discloses an apparatus which has a solenoid control valve in a purge passage. The solenoid control valve is driven by a pulse waveform signal to control the purging flow rate of evaporative fuel fed into an intake passage. For this apparatus, the pulse waveform signal has a duty ratio and a signal frequency which is substantially inverse-proportional to the duty ratio. During low load such as idling, the duty ratio is decreased in order to lower the purging flow rate. And this makes control signal frequency high, evaporative fuel can be more continuously supplied into the intake passage. Consequently, the mixing condition of the evaporative fuel supplied from the purging passage and the gaseous mixture in the intake passage is somewhat improved.

However, in this apparatus, a high frequency control signal which is supplied to the control valve impairs the controllability of the control valve itself because of the specific response characteristic of the control valve itself. Moreover, the high frequency control signal increases the operating frequency of the control valve and makes the operating noise of the control valve more noticeable.

To overcome this disadvantage, Japanese Utility Model Laid-Open No. 4-1658(1658/1992) discloses an apparatus in which only during idling operation, the frequency of the control signal supplied to the control valve is made lower than the frequency of the control signal in the other operations. The control signal with lowered frequency improves the controllability of the control valve, and the lowered operating frequency of the control valve makes the operating noise of the control value more unnoticeable.

However, in the apparatus as shown in Japanese Utility Model Laid-Open No. 4-1658, during idling operation, because of the low frequency of the control signal to be applied to the control valve, the purging fuel is intermittently supplied to the intake passage. As a result, the mixing condition of the evaporative fuel supplied from the purging passage and the gaseous mixture in the intake passage may be sometimes unsatisfactory. In other words, it is difficult to achieve both the controllability as desired of the purging flow rate at a small duty ratio and the controllability as desired of the purging flow rate at a medium-to-high duty ratio.

SUMMARY OF THE INVENTION

It is an object of the present invention to provide an improved system capable of controlling purging flow rate in the range of low purging flow rate to high purging flow rate.

To achieve the above object, a system in conjunction with the present invention is an evaporative fuel supply system for an internal combustion engine having an intake passage to which liquid fuel in a-fuel tank is supplied.

The evaporative fuel supply system comprises a canister containing an evaporative fuel adsorbent for adsorbing evaporative fuel, which is generated in said fuel tank and fed to the canister; a purging passage fluidicly communicating said canister to said intake passage of the internal combustion engine for purging the evaporative fuel adsorbed by the evaporative fuel adsorbent to be fed into the intake passage; a solenoid control valve provided in the purging passage for controlling a flow rate of a gaseous mixture containing the evaporative fuel purged from the canister and being repeatably opened and closed by a control signal; a detector for detecting an operating condition of the internal combustion engine; a purging flow rate determinator for determining the flow rate of the evaporative fuel to be purged into the purging passage based on the detected operating condition; a duty ratio determinator for determining a control signal duty ratio corresponding to the determined purging flow rate from the purging flow rate determinator; a duty ratio comparator for comparing the control signal duty ratio with a preset duty ratio and calculating a result of comparison; a period selector for selecting one control signal period which creates the substantial linearity of the change in an actual purging flow rate with respect to the change in the control signal duty ratio in said purging passage among different preset control signal periods according to the result of comparison; a waveform generator for generating a pulse waveform signal having the selected control signal period from the period selector and the determined control signal duty ratio from the duty ratio determinator, and for outputting the pulse waveform signal as a control signal to the control valve.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

The present invention will be described in detail with reference to the drawings which show the preferred embodiments thereof.

Figure 1:
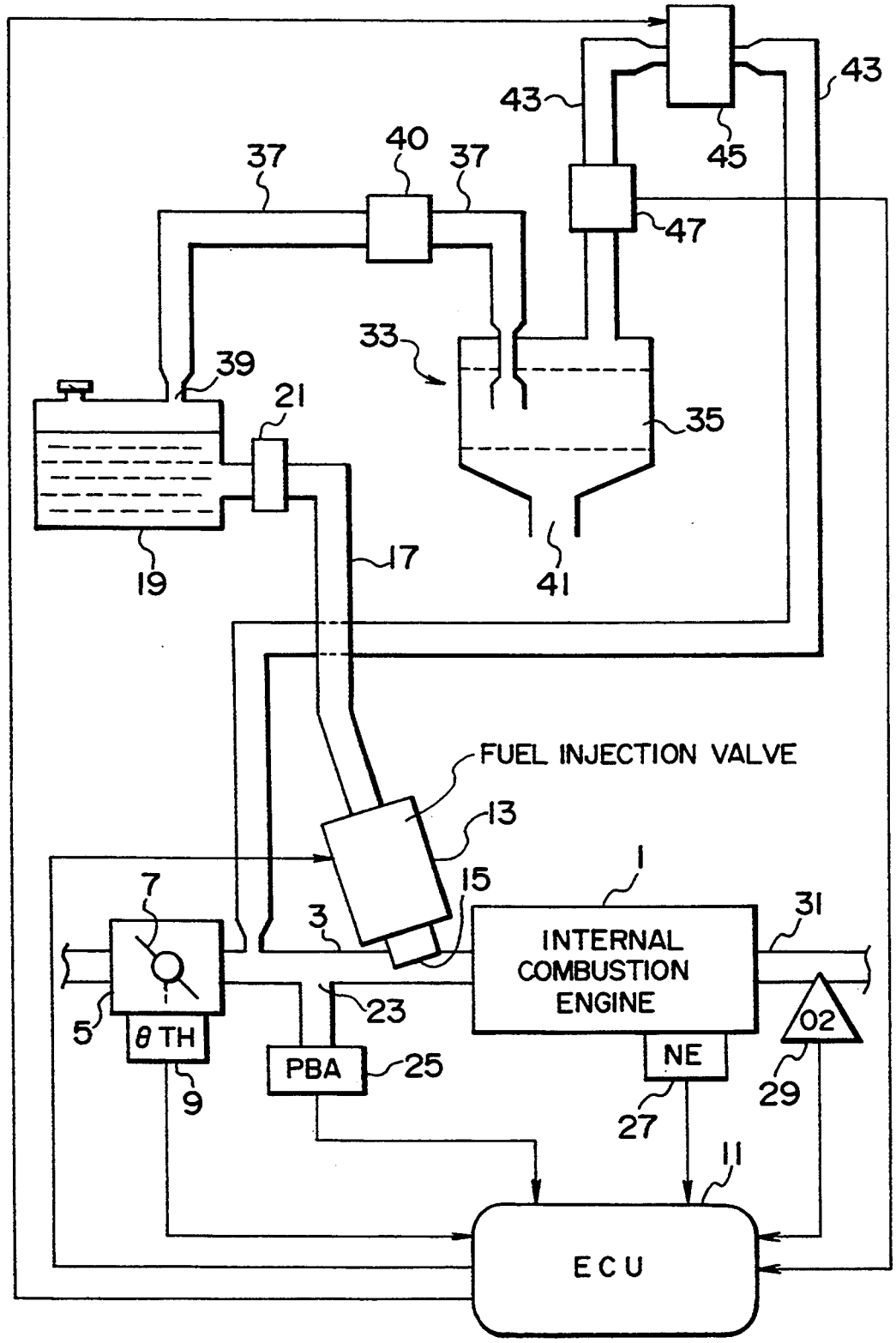
FIG. 1 is a schematic diagram showing the whole arrangement of an evaporative fuel supply control system for an internal combustion engine in which the system of the present invention is employed.

Referring now to the drawings, and particularly, to FIG. 1, there is illustrated the whole arrangement of an evaporative fuel supply control system of an internal combustion engine which is provided with an evaporative fuel-purging control system according to the present invention. In FIG. 1, reference numeral 1 designates an internal combustion engine, which is installed in an automotive vehicle, not shown. An intake pipe 3 is connected to the cylinder block of the internal combustion engine 1. The inside of the pipe 3 is in fluidic communication with an intake portion in the cylinder block, not shown. The pressure inside the pipe 3 turns negative during the operation of engine 1.

Figure 2:
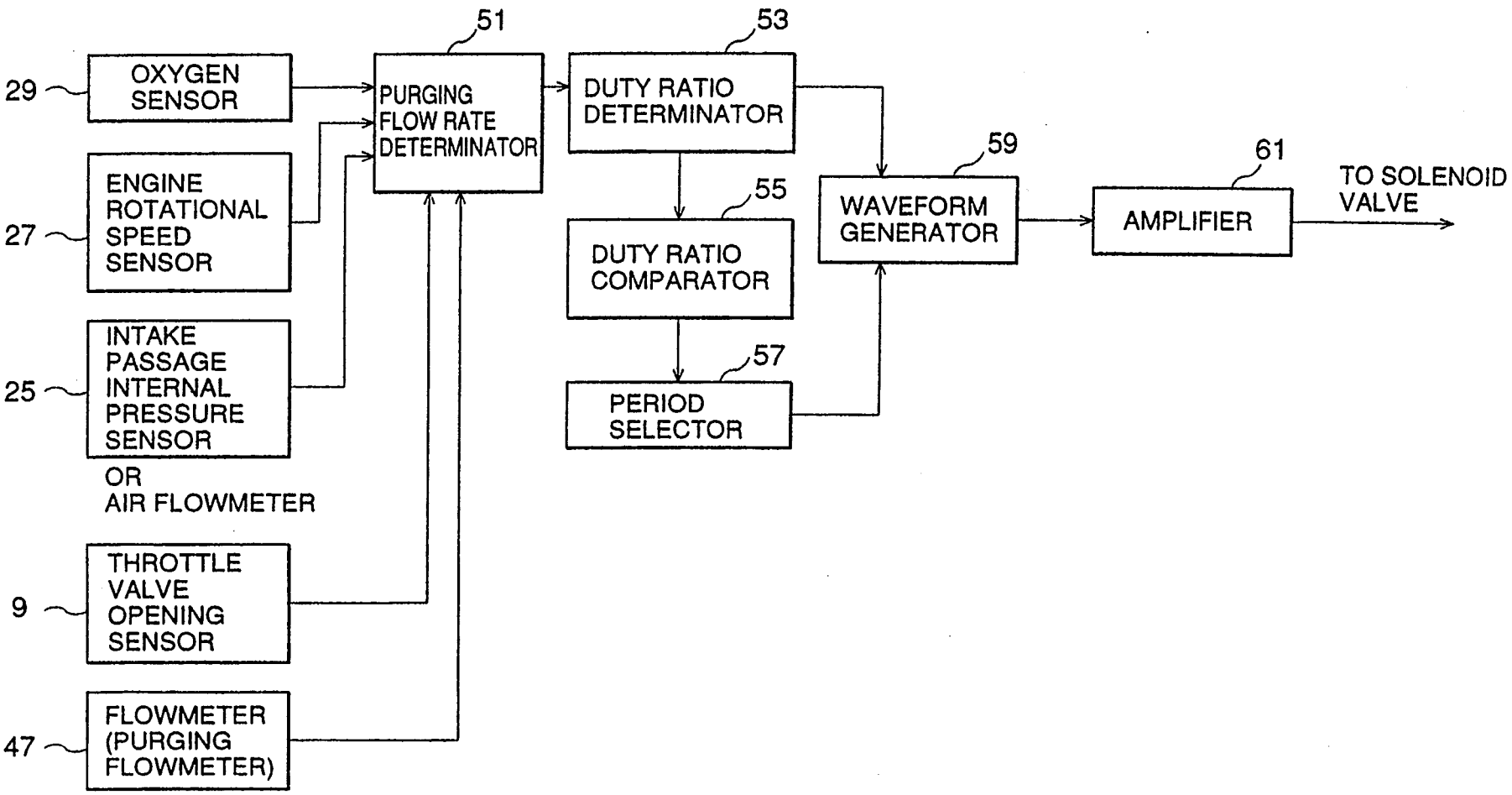
FIG. 2 is a block schematic diagram of functional blocks in an ECU in which the system for the present invention is employed.

A throttle body 5 is interposed in the intake pipe 3. A throttle valve 7 is provided in the throttle body 5. A throttle valve opening (STH) sensor 9 is connected to the throttle valve 7 for generating an electric signal corresponding to the opening amount of the throttle valve 7. This electric signal is applied to an electronic control unit 11 (hereinafter called ECU). The ECU 11 comprises, as shown in FIG. 2, and a system for controlling the fuel injection and an evaporative fuel purging control system which includes a purging flow rate determinator 51, a duty ratio determinator 53, a duty ratio comparator 55, a period selector 57, a waveform generator 59 and an amplifier 61. The period selector 57 is equivalent to a frequency selector because a period is a reciprocal of a frequency.

Fuel injection outlets 15 of fuel injection valves 13, only one of which is shown, are connected to the intake pipe 3 between the internal combustion engine 1 and the throttle valve 7, at a position adjacent to the internal combustion engine 1. Each fuel injection valve 13 is connected to a fuel tank 19 via a fuel pipe 17, and a fuel pump 21 is provided across the fuel pipe. Each fuel injection valve 13 is connected to the ECU 11 via a signal line in order to control duration of the valve opening.

An intake passage internal pressure (PBA) sensor 25 is connected to the intake pipe 3 between the internal combustion engine 1 and the throttle valve 7 at a location 23 immediately downstream of the throttle valve 7, where the throttle valve 7 is close to. The intake passage internal pressure sensor 25 is electrically connected to the above-described ECU 11 via a signal line which supplies an intake passage negative pressure signal to the ECU 11.

An engine rotational speed (NE) sensor 27 is installed near a camshaft or a crankshaft, not shown, of the internal combustion engine 1. The engine rotational speed sensor 27 can generate a signal pulse (hereinafter called "TDC crank signal pulse") whenever the crankshaft rotates throughout 180 degrees. The TDC signal pulse is applied to the ECU 11.

An oxygen sensor 29 as an exhaust gas concentration sensor is mounted in an exhaust pipe 31 of the internal combustion engine 1, for sensing the concentration of oxygen contained in exhaust gases and applying a signal indicative of the oxygen concentration to the ECU 11.

The evaporative fuel supply control system further comprises a canister 33. The canister 33 is a container containing an evaporative fuel adsorbent 35 such as an activated carbon for adsorbing evaporative fuel. The canister 33 is connected to an upper portion 39 of the fuel tank 19 via an vapor pipe 37. The evaporative fuel generated in the fuel tank 19 is fed into the canister 33 and in turn adsorbed by the adsorbent 35 in the canister 33. A two-way valve 40 is located across the vapor pipe 37. The two-way valve 40 comprises a positive pressure valve which opens when the positive pressure of the evaporative fuel generated in the fuel tank 19 reaches predetermined pressure, and a negative pressure valve which opens when the negative pressure in the fuel tank comes down to predetermined pressure. When the pressure of the evaporative fuel increased and reaches to the predetermined pressure and the positive pressure valve opens, the evaporative fuel in the fuel tank 19 is fed into the canister 33 through the vapor pipe 37. On the other hand, when the pressure in the fuel tank 19 is reduced, for example due to low ambient temperature and the negative pressure valve opens, the evaporative fuel in the canister 33 is returned to the fuel tank 19 through the vapor pipe 37. An outside air inlet 41 is provided in the canister 33, for introducing air into the canister 33 when the pressure of the canister 33 comes down to negative pressure.

Further, the canister 33 is connected to the intake pipe 3 downstream of the throttle body 5 via a purging pipe 43. The evaporative fuel adsorbed by the adsorbent 35 and temporarily stored in the canister 33 is, together with outside air sucked from the outside air inlet 41, introduced into the intake pipe 3 through the purging pipe 43 by the negative intake pressure generated in the intake passage 3.

As described above, the evaporative fuel generated in the fuel tank 19 is prevented from being emitted into the atmosphere by the function of the canister 33, the vapor pipe 37, the purging pipe 43 and the two-way valve 40, etc.

A control valve 45 is interposed in the purging pipe 43 to control the amount of evaporative fuel, ie. the purging flow rate, introduced to the intake passage from the canister 33. The electromagnetic control valve 45 basically comprises a solenoid, a plunger and a valve, as they are well-known. The valve 45 opens and closes as the plunger is reciprocated by the solenoid. The solenoid of the control valve 45 is electrically connected to the ECU 11 via the signal line, and the valve is opened and closed repeatably at high speed by a control signal which is a pulse waveform signal, i.e. on-off signal, supplied from the ECU 11. The control valve 45 controls the purging flow rate with changing its open-close ratio. The open-close ratio of the control valve is substantially equal to the duty ratio of the control signal. That is, the control valve opens when the control signal is on, and the control valve closes when the control signal is off. The control signal applied to the control valve 45 is a signal that a duty ratio is varied under the control of ECU 11.

A flowmeter 47 is provided in the purging pipe 43, preferably between the canister 33 and the control valve 45, and electrically connected to the ECU 11 via the signal line, for transmitting an electric signal indicative of flow rate in the purging pipe 43 to the ECU 11. The flowmeter 47 is, for example, a hot wire type which utilizes the nature of a platinum wire that when the platinum wire is heated by electric current applied thereto and at the same time exposed to a flow of gas, the platinum wire loses its heat to decrease in temperature so that its electric resistance decreases.

The ECU 11 comprises an input circuit (not shown) for connecting various sensors or detectors such as the throttle valve opening sensor 9, the intake passage internal pressure sensor 25, the engine rotational speed sensor 27, the oxygen sensor 29 and the mass flow meter 47 to the ECU 11. The input circuit has functions for amplifying and compensating input signals from detectors (e.g., shaping a waveform of an input signal, amplifying a voltage), and converting an analog signal into a digital signal if necessary. The ECU 11 further comprises a central processing unit (CPU) which executes various programs such as for calculating various controlling amount (e.g., control parameters) of the control valve 45 for controlling the purging flow rate, a memory unit for storing the programs executed by the CPU and for storing results of calculations therefrom, and an output circuit, including a waveform generator 59 and a amplifier 61, which outputs control signals to the fuel injection valve 13 and the control valve 45 etc.

The control valve 45 can be controlled by an output signal of the ECU 11 so that the actual flow rate obtained from an output value of the flowmeter 47 matches with a desired value preliminarily decided in accordance with the driving condition of the internal combustion engine 1.

As shown in FIG. 2, the ECU includes the purging rate determinator 51, the duty ratio determinator 53, the duty ratio comparator 55, the period selector 57, the waveform generator 59, and the amplifier 61. Although these elements 51, 53, 55, 57 may be incorporated as specific circuit units, programs which are executed by the CPU in the ECU 11 function as the elements in this embodiment.

The information from various sensors, such as the oxygen sensor 29, the engine rotational speed sensor 27, the intake passage internal pressure sensor (PB sensor) 25, the throttle valve opening sensor 9, and the flowmeter 47 is collected to the ECU 11. The. purging flow rate determinator 51 determines the desired purging flow rate on the basis of the information. The duty ratio determinator 53 determines the control signal duty ratio corresponding to the determined purging flow rate. Next, this control signal duty ratio is applied to the duty ratio comparator 55 and compared with a preset duty ratio in the memory unit of the ECU 11. The results of comparison (value of duty ratio corresponding to each preset duty ratio) are supplied to the control period selector 57 which selects a control signal period from the preset periods stored in the memory unit. This signal period is equivalent to a reciprocal of the purging control signal frequency. The waveform generator 59 generates an waveform the control signal on the basis of both the duty ratio form the duty ratio determinator 53 and the period from the period selector 57 and applies the control signal with the generated waveform to the amplifier 61. The amplifier 61 amplifies the input signal to be sufficient in power for driving the control valve 45, which is applied to the control valve 45.

Figure 3:
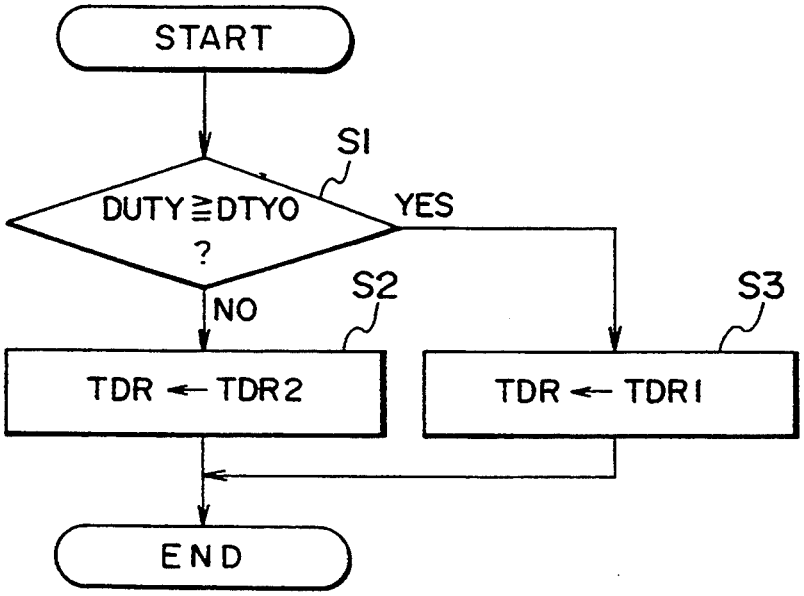
FIG. 3 is a flowchart of a process carried out in a CPU of an ECU, in which an embodiment of selecting control signal period TDR from two preset periods according to preset duty ratio is employed.

FIG. 3 is a flowchart of a process employed in the CPU of the ECU 11, showing an embodiment in which the selection of an control signal period TDR from two preset periods with regard to one preset duty ratio is carried out.

As described above, the control signal duty ratio determined by the duty ratio determinator 53 is applied to the period determinator 57. As shown in Step S1 of FIG. 3, the duty ratio comparator 55 decides whether or not the control signal duty ratio DUTY, which is to fed into the control valve 45, is above the set duty ratio DTY0 (e.g., 35%). If DUTY≧DTY0, the period selector 57 selects a first period TDR1 (e.g., 80 msec) as an control signal period TDR as shown in Step S2. On the other hand, if DUTY<DTY0, the period selector 57 selects a second period TDR2 (e.g., 160 msec) as an control signal period TDR as shown in Step S3. The selected period together with the control signal duty ratio is applied to the waveform generator 59, and the waveform generator 59 generates the control signal based on the period TDR and the duty ratio DUTY.

Figure 4:
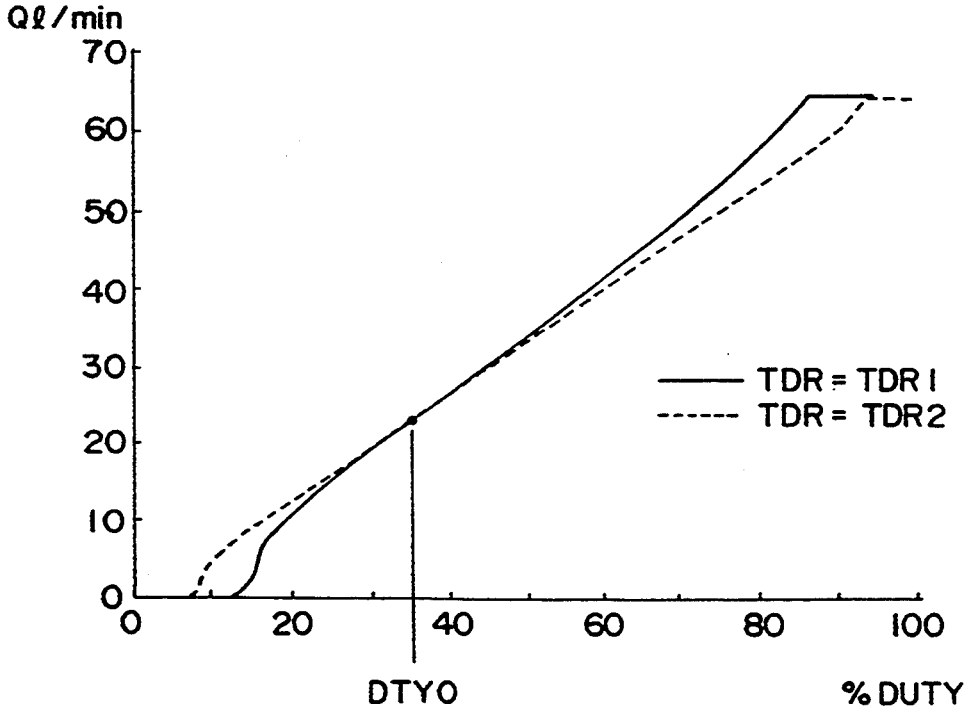
FIG. 4 is a graphical representation which shows a relation of a flow rate Q of gaseous mixture containing an evaporative fuel with respect to the change in signal duty ratio DUTY.

FIG. 4 is a graphical representation showing the relation of a flow rate Q of gaseous mixture containing an evaporative fuel flowing through the purging pipe 43 with respect to the change in control signal duty ratio DUTY when the control signal period TDR is selected from the set period TDR 1 and TDR2 as similar to FIG. 3. In FIG. 4, a solid line shows the relation when the control signal period is in the state of TDR=TDR (80 msec) and a dotted line shows the relation when the control signal period is in the state of TDR=TDR2 (160 msec). As understood from FIG. 4, the characteristic of the flow rate Q with respect to the change in duty ratio of the solid line TDR1 (80 msec) is different from the characteristic of the flow rate Q with respect to the change in duty ratio of the dotted line TDR2 (160 msec). The characteristic of the solid line with a short signal period (80 msec) has substantial linearity of the change in the flow rate Q with respect to the change in duty ratio DUTY (hereinafter abbreviated linearity) for high duty ratio DUTY, and the characteristic of the dotted line with a long signal period (160 msec) has substantial linearity for low duty ratio DUTY.

Thus, to have substantial linearity in every range of control signal duty ratio DUTY, it is preferred that the control signal period should be selected in accordance with the change in duty ratio DUTY so that the selection of the control signal period could create the substantial linearity. In other words, duty ratio DUTY is compared with the preset duty ratio in the duty ratio comparator 55, and according to the result of comparison, the period selector 57 selects one control signal period which creates the substantial linearity of the change in an actual purging flow rate with respect to the change in said control signal duty ratio in said purging pipe 43 from two preset control signal periods.

In the present embodiment, the solid line of a control signal period TDR=TDR1 (80 msec) intercepts with the dotted line of a control signal period TDR=TDR2 (160 msec) at a point of intersection DTY0 (about 35%).

Therefore, the intersection DTY0 is defined as the preset duty ratio which functions as a threshold value, and the selection of the control signal period TDR is carried out by whether or not the control duty ratio is above the set duty value and the linearity as a result is improved.

The reason why the linearity changes with differing control signal period TDR is considered to be the influence of inductance in an electromagnetic coil or solenoid constituting the control valve 45, a material of a magnetic body of magnetic circuit constituted with the electromagnetic coil, and the inertia of the mass of plunger for operating a valve body which is integrally provided on the plunger.

Accordingly, as described above, as the control signal period TDR is selectable, the substantial linearity is obtained in both the low flow rate range (i.e., a region the low duty ratio is low, DUTY≧DTY0) and the middle-high flow rate range (i.e., a region the duty ratio is middle to high, DUTY>DTY0).

Figure 5A:
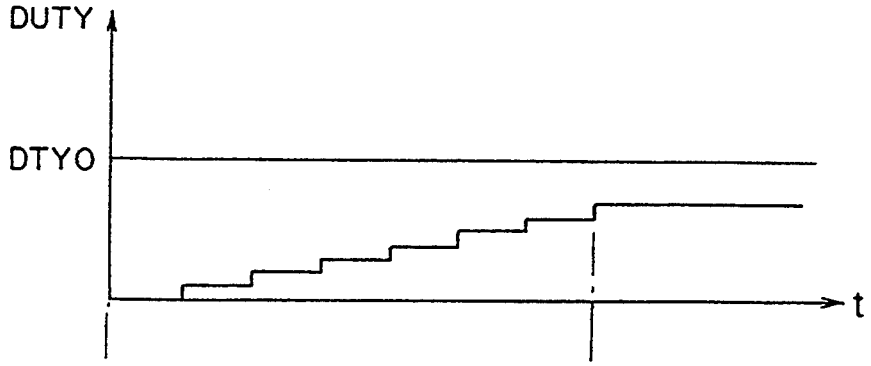
FIG. 5 is a graphical representation which shows the change in flow rate Q as time elapses within a low flow rate region.
Figure 5B:
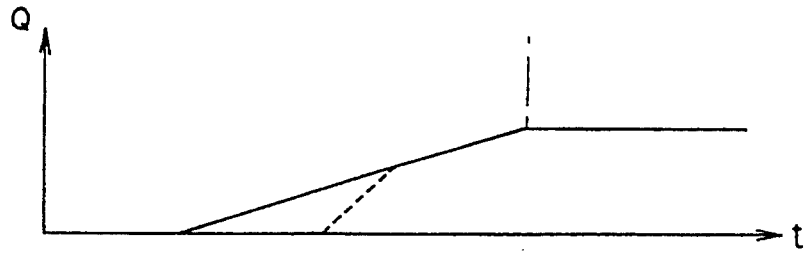
Figure 6A:
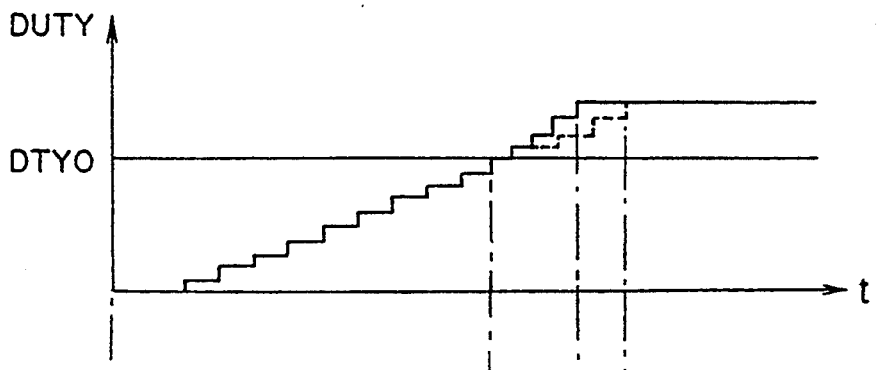
FIG. 6 is a graphical representation which shows the change in flow rate Q as time elapses within a low-to-high flow rate region.
Figure 6B:
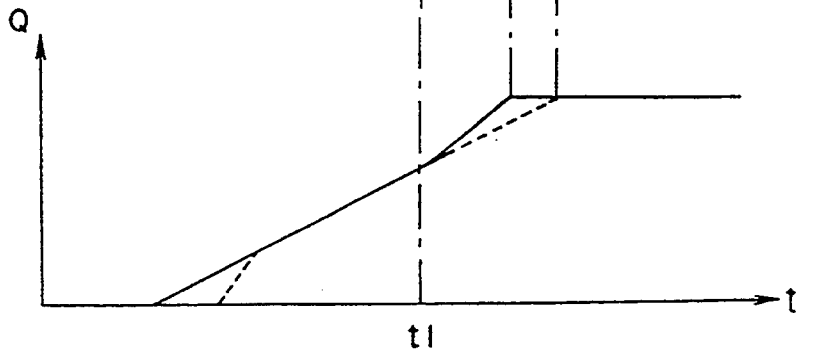

FIG. 5 and FIG. 6 show, as similar to FIG. 3, a case that the control period TDR is selected from two set periods TDR1 and TDR2, and shows how the flow rate Q is varied with respect to a change in duty ratio when the duty ratio DUTY is increased as time elapses. In FIG. 5 and FIG. 6, a dotted line shows the conventional example and a solid line shows the present embodiment.

FIG. 5 is a graphical representation which shows a case of operating the control valve in a low flow rate range (i.e., a region the low duty ratio DUTY is low, ≧DTY0). As understood from FIG. 5, the linearity is improved as compared with the conventional type of the system as described above. Particularly during small duty ratio region, FIG. 5 shows that in the region of small duty ratio DUTY, the flow rate Q corresponds to the duty ratio DUTY to a desired degree.

FIG. 6 is a graphical representation in which the operation of the control valve in a middle to high flow rate range when accelerating (i.e., in a region the duty ratio is middle to highs DUTY>DTY0) the engine. This also shows the improved linearity of the low flow rate region. Moreover, the control signal period becomes short (TDR=TDR1) after time t1, so that the increment of the duty ratio DUTY with respect to the elapse of time is high, which means the response of valve operation is improved because the control valve is driven with the signal of short period.

As understood from the above description, with the apparatus of the present invention, within all purging flow rate range, such as low-to-high flow rate range, the linearity of the flow rate Q with respect to the duty ratio DUTY can be improved. With the improvement of linearity, the controllability of purging flow rate is enhanced. Further, the long control signal period in the low flow rate range brings about the stability of air-fuel ratio, the short control signal period in the middle-high flow rate range improves the response of the control valve (speed of change in purging flow rate with respect to the change in duty ratio) and leads to the improvement of exhaust gas characteristics.

In the present invention, the purging flow rate determinator 51, the duty ratio determinator 53, the duty ratio comparator 55, the period selector 57, the waveform generator 59, and the amplifier 61 are provided in the ECU 11, but they may be provided independent from the ECU 11.

The sensors or detectors 9, 25, 27, 29, 47 for detecting the condition of the engine are not described for the purpose of limitation, and the other kinds of sensors may be used for providing signals to the ECU 11. For example, and air flowmeter may be provided in the intake passage in place of the intake passage internal pressure sensor 25.

Further, the information from the mass flowmeter 47 can be returned as a feedback signal to the evaporative purging control system to improve the controllability of the control valve.

Furthermore, although the embodiment described above relates to the purging flow rate control in which the low-to-high flow rate range is divided into two separate regions using two different control signal periods, the invention could be utilized for three or more separate flow rate regions using three or more control signal periods to accomplish the substantial linearity in each region.

As understood from the above description, the present invention relates to a field of evaporative fuel supply systems of internal combustion engines for introducing evaporative fuel generated from a fuel tank to an intake passage of the internal combustion engine, and in particular, the present invention provides the significant improvement of controllability of purging flow rate of the evaporative fuel purging control system.

Further, the present invention provides the evaporative fuel-purging control system capable of significantly improving the linearity of the actual purging flow rate with respect to the duty ratio of signal by selecting the optimum period of the control signal for driving the control valve in order to improve the controllability of purging flow rate.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Utility Model Application No. 5-64990(64990/1993) filed on Nov. 10, 1993 is hereby incorporated by reference.

What is claimed is:

1. An evaporative fuel supply system for an internal combustion engines having an intake passage to which liquid fuel in a fuel tank is supplied, said evaporative fuel supply system for the internal combustion engines comprising:

a canister containing an evaporative fuel adsorbent for adsorbing evaporative fuel, the evaporative fuel generated in said fuel tank and fed to said canister;

a purging passage fluidicly communicating said canister to said intake passage of said internal combustion engine, for purging the evaporative fuel adsorbed by said evaporative fuel adsorbent to be fed into said intake passage;

a solenoid control valve provided in said purging passage, for controlling a flow rate of a gaseous mixture containing the evaporative fuel purged from said canister, said control valve being repeatably opened and closed by a control signal;

a detector for detecting an operating condition of said internal combustion engine;

a purging flow rate determinator for determining the flow rate of the evaporative fuel to be purged into said purging passage, based on the operating condition of said internal combustion engine detected by said detector;

a duty ratio determinator for determining a control signal duty ratio corresponding to the determined purging flow rate from said purging flow rate determinator;

a duty ratio comparator for comparing the control signal duty ratio with a preset duty ratio and calculating a result of comparison;

a period selector for selecting one control signal period which creates substantial linearity of the change in actual purging flow rate with respect to the change in the control signal duty ratio in said purging passage among different preset control signal periods according to said result of comparison; and a waveform generator for generating a pulse waveform signal having the selected control signal period from said period selector and the determined control signal duty ratio from said duty ratio determinator, and for outputting the pulse waveform signal as the control signal to said control valve.

2. An evaporative fuel supply system according to claim 1, wherein said preset control signal periods are decided based on the characteristic of said control valve.

3. An evaporative fuel supply system according to claim 1, wherein said preset control signal periods are a first and a second preset control signal period, and wherein said evaporative fuel supply system selects a control signal period from the first and the second preset control signal period, using one said preset duty ratio as a threshold value.

4. An evaporative fuel supply system according to claim 3, wherein said preset duty ratio is a duty ratio corresponding to a point at which a curve of an actual purging flow rate-duty ratio of said first preset control period and a curve of an actual purging flow rate-duty ratio of said second preset control signal are intercepted.

5. An evaporative fuel supply system according to claim 4, wherein said period selector selects said first preset control signal period when an control signal duty ratio determined by said duty ratio determinator is larger than said preset duty ratio, and said second preset control signal period when an control signal duty ratio determined by said duty ratio determinator is smaller than said preset duty ratio.

6. An evaporative fuel supply system according to claim 1, further comprising an amplifier for amplifying said pulse waveform signal outputted from said waveform generator to said control valve.

7. An evaporative fuel supply system according to claim 1, further comprising a flowmeter provided in said purging passage between said control valve and said canister, for detecting a flow rate of gaseous mixture containing an evaporative fuel purged from said canister.

8. An evaporative fuel supply system according to claim 1, wherein said detector is an intake passage internal pressure sensor.

9. An evaporative fuel supply system according to claim 1, wherein said detector is an engine rotational speed sensor.

10. An evaporative fuel supply system according to claim 1, wherein said detector is a throttle valve opening sensor.

11. An evaporative fuel supply system according to claim 1, wherein said detector is an oxygen sensor.

12. An evaporative fuel purging control method for an internal combustion engines having an intake passage to which liquid fuel in a fuel tank is supplied, said method being applied to an evaporative fuel supply system which includes a canister containing an evaporative fuel adsorbent for adsorbing evaporative fuel, the evaporative fuel generated in said fuel tank and fed to said canister; a purging passage fluidicly communicating said canister to said intake passage of said internal combustion engine, for purging the evaporative fuel adsorbed by said evaporative fuel adsorbent to be fed into said intake passage; a solenoid control valve provided in said purging passage, for controlling a flow rate of a gaseous mixture containing the evaporative fuel purged from said canister said control valve being repeatably opened and closed by a control signal; a detector for detecting an operating condition of said internal combustion engine; and a controller for controlling said control valve, based on the operating condition of said internal combustion engine detected by said detector, said evaporative fuel purging control method comprising the steps of:

determining the flow rate of the evaporative fuel to be purged into said purging passage, based on said detected operating condition;

determining a control signal duty ratio corresponding to a determined purging flow rate;

calculating a result of comparison between said control signal duty ratio and a preset duty ratio;

selecting one control signal period which creates substantial linearity of the change in an actual purging flow rate with respect to the change in said control signal duty ratio in said purging passage among different preset control signal periods according to said result of comparison;

generating a pulse waveform signal as the control signal having the selected control signal period and the determined signal duty ratio; and controlling said control valve in accordance with said pulse waveform signal.

13. An evaporative fuel purging control method according to claim 12, wherein said preset control signal periods are decided based on the characteristic of said control valve.

14. An evaporative fuel purging control method according to claim 13, wherein said preset control signal periods are a first and a second preset control signal period, and wherein said evaporative fuel purging control method comprises the step of selecting an control signal period from the first and the second preset control signal period, using one said preset duty ratio as a threshold value.

15. An evaporative fuel purging control method according to claim 14, wherein said preset duty ratio is a duty ratio corresponding to a point at which a curve of an actual purging flow rate-duty ratio of said first preset control period and a curve of an actual purging flow rate-duty ratio of said second preset control signal are intercepted.

16. An evaporative fuel purging control method according to claim 15, wherein said step of selecting one control signal period comprises selecting said first preset control signal period when the control signal duty ratio determined is larger than said preset duty ratio, and said second preset control signal period when the determined control signal duty ratio is smaller than said preset duty ratio.

17. An evaporative fuel purging control system utilized in an evaporative fuel supply system for an internal combustion engines having an intake passage to which liquid fuel in a fuel tank is supplied, said evaporative fuel supply system including: a canister containing an evaporative fuel adsorbent for adsorbing evaporative fuel, the evaporative fuel generated in said fuel tank and fed to said canister, a purging passage fluidicly communicating said canister to said intake passage of said internal combustion engine, for purging the evaporative fuel adsorbed by said evaporative fuel adsorbent to be fed into said intake passage, and a solenoid control valve provided in said purging passage, for controlling a flow rate of a gaseous mixture containing said evaporative fuel purged from said canister, said control valve being repeatably opened and closed by a control signal, said evaporative fuel purging control system comprising:

a purging flow rate determinator for determining the flow rate of the evaporative fuel to be purged into said purging passage, based on an operating condition of said internal combustion engine;

a duty ratio determinator for determining a control signal duty ratio corresponding to the determined purging flow rate from said purging flow rate determinator;

a duty ratio comparator for comparing the control signal duty ratio with a preset duty ratio and calculating a result of comparison;

a period selector for selecting one control signal period which creates substantial linearity of the change in actual purging flow rate with respect to the change in the control signal duty ratio in said purging passage among different preset control signal periods according to said result of comparison; and a waveform generator for generating a pulse waveform signal having the selected control signal period from said period selector and the determined control signal duty ratio from said duty ratio determinator, and for outputting the pulse waveform signal as the control signal to said control valve.

18. An evaporative fuel purging control system according to claim 17, wherein said preset control signal periods are decided based on the characteristic of said control valve.

19. An evaporative fuel purging control system according to claim 18, wherein said preset control signal periods are a first and a second preset control signal period, and wherein said evaporative fuel purging control system selects a control signal period from the first and the second preset control signal period, using one said preset duty ratio as a threshold value.

20. An evaporative fuel purging control system according to claim 17, wherein said preset duty ratio is a duty ratio corresponding to a point at which a curve of an actual purging flow rate-duty ratio of said first preset control period and a curve of an actual purging flow rate-duty ratio of said second preset control signal are intercepted.

21. An evaporative fuel purging control system according to claim 20, wherein said period selector selects said first preset control signal period when an control signal duty ratio determined by said duty ratio determinator is larger than said preset duty ratio, and said second preset control signal period when an control signal duty ratio determined by said duty ratio determinator is smaller than said preset duty ratio.

22. An evaporative fuel purging control system according to claim 17, further comprising an amplifier for amplifying said pulse waveform signal outputted from said waveform generator to said control valve.

* * * * *